United States Patent [19]

Hebels

[11] Patent Number: 4,883,209

[45] Date of Patent: Nov. 28, 1989

[54] APPARATUS FOR THREADING THE LEADERS OF FLEXIBLE WEBS IN A PROCESSING MACHINE

[75] Inventor: Albert Hebels, Hamburg, Fed. Rep. of Germany

[73] Assignee: PAGENDARM Beschichtungstechnik GmbH, Hamburg, Fed. Rep. of Germany

[21] Appl. No.: 212,202

[22] Filed: Jun. 24, 1988

[30] Foreign Application Priority Data

Jul. 7, 1987 [DE] Fed. Rep. of Germany ..... 3722345

[51] Int. Cl.[4] ..... G03D 13/10; B65H 20/16

[52] U.S. Cl. ..... 226/92; 226/91

[58] Field of Search ..... 226/91, 92; 406/196, 406/198, 184; 198/630; 104/93, 107

[56] References Cited

U.S. PATENT DOCUMENTS 4,063,505 12/1977 Sasamoto et al. ..... 226/91 X
4,124,115 11/1978 Moss ..... 198/630
4,330,191 5/1982 Rawlings et al. ..... 226/92 X
4,359,946 11/1982 Marvin ..... 104/93
4,423,685 1/1984 Kerckhoff ..... 104/93 X
4,480,801 11/1984 Stone ..... 226/92 X
4,706,862 11/1987 Theilacker ..... 226/92

*Primary Examiner*—Daniel P. Stodola
*Assistant Examiner*—Phillip S. Han
*Attorney, Agent, or Firm*—Peter K. Kontler

[57] ABSTRACT

Apparatus for threading the leader of a flexible web through a coating, drying or other processing machine has an elongated steel strip which is adjacent the path of movement of the web through the machine and one side of which is overlapped by an inflatable hose. The leader of the web is separably coupled to a follower by a wire or cord, and the follower tracks the strip and simultaneously overlies and deflates a portion of the hose. The hose is connected with a source of compressed air, at least at one side of the follower, so that when the source admits compressed air into the hose, the latter is inflated and propels the follower along the strip. The follower has a smooth-surfaced slightly convex first roll which overlies and deforms the adjacent portion of the hose, and a flanged second roll which engages the strip opposite the hose so that the strip and the hose are located between the two rolls.

20 Claims, 3 Drawing Sheets

APPARATUS FOR THREADING THE LEADERS OF FLEXIBLE WEBS IN A PROCESSING MACHINE

BACKGROUND OF THE INVENTION

The invention relates to improvements in machines for treating elongated flexible bodies, such as webs or strips of metallic, plastic, textile or other material which are to be subjected to one or more treatments, e.g., drying, wetting, cooling, heating, coating, stretching, dipping and/or others. More particularly, the invention relates to improvements in apparatus which can be used in such machines to thread the leaders of elongated flexible bodies into an elongated path along which the bodies must be transported (e.g., pushed and/or pulled) in the course of treatment at one or more stations.

It is already known to employ automatic threading apparatus for the leaders of webs or strips of flexible material (e.g., paper) which must be advanced along an elongated and often quite complex path (e.g., along a path having straight and slightly and/or strongly curved sections). For example, British Pat. No. 1 240 790 discloses a threading apparatus wherein an endless chain conveyor is adjacent the path for the elongated flexible body to be treated in a processing machine. The chain conveyor carries a gripper (such as tongs) which can engage the leader of the flexible body and entrains the body along the prescribed path when the conveyor is set in motion. A similar threading apparatus is disclosed in British Pat. No. 2 133 77 wherein the conveyor is an endless chain or an endless toothed belt and is provided with an entraining element in the form of a pin or clamp which can be caused to engage the leader of the flexible body. A drawback of the above described and other conventional threading apparatus (e.g., those wherein the nips of advancing rolls must be opened by chain or belt followers in order to provide room for introduction of the leader of an elongated web or strip of flexible material) is their complexity, bulk and high cost. Furthermore a chain conveyor is likely to generate much noise and requires constant or frequent lubrication and/or other forms of maintenance.

OBJECTS AND SUMMARY OF THE INVENTION

An object of the invention is to provide a simple, compact and inexpensive apparatus which can be used as a superior substitute for heretofore known threading apparatus in connection with the advancement of leaders of flexible webs or strips of paper, plastic or metallic foil, textile material or the like into an elongated path in a processing or like machine.

Another object of the invention is to provide a threading apparatus which occupies little room in or next to a processing machine, which can advance (with or without elongated flexible bodies) in several directions, which comprises a small number of parts, and whose operation is substantially or totally noiseless.

A further object of the invention is to provide an apparatus which can be used with equal or similar advantage for the threading of elongated flexible bodies into straight, partly straight and partly arcuate and/or other simple, complex or highly complex paths.

An additional object of the invention is to provide the apparatus with novel and improved means for propelling the leader of a flexible body into and along the selected path.

Still another object of the invention is to provide an apparatus whose energy consumption is low and which requires little or no maintenance.

A further object of the invention is to provide a machine which embodies the above outlined apparatus.

An additional object of the invention is to provide a method of advancing the leaders of elongated flexible bodies along simple or complex paths within short intervals of time and in such a way that the leaders are accessible at all times for detachment from the threading apparatus.

The invention is embodied in an apparatus for threading the leader of an elongated flexible body (such as a web of paper, a web of metallic or plastic foil or a web of textile material) into an elongated path wherein the body is coated, dried, moisturized, heated, cooled and/or otherwise treated. The apparatus comprises an elongated track which is adjacent and has an outline at least substantially conforming to that of the path for the elongated body, a deformable and inflatable hose which is adjacent the track, a follower which is connectable with the leader of the elongated body to be threaded and is mounted on the track so as to deform the adjacent portion of the hose, and means for admitting a pressurized fluid into the hose by way of an opening at one side of the follower so that the pressurized fluid inflates the hose at the one side of the follower and the inflated hose propels the follower along the track in a predetermined direction. The track can include a rail (such as an elongated strip of steel or other suitable metallic material) a first side of which is adjacent the hose and a second side of which is engaged by a portion of the follower. Another portion of the follower overlies and deforms the hose at the one side of the rail. The other portion of the follower can include a rolling element (such as a roll having a slightly convex smooth peripheral surface) which is in deforming engagement with the hose. A second rolling element can constitute or form part of that portion of the follower which engages the rail. The two rolling elements define a clearance for the track and for a portion of the hose in deflated condition of such portion of the hose. At least one of the rolling elements (particularly the one which directly engages the track) can be provided with flanges which flank the track and ensure that the follower is properly guided by the track.

The apparatus preferably further comprises means for attaching the follower to the elongated flexible body which must be threaded into the path, and such attaching means can comprise a length of wire or cord and means for separably coupling the wire or cord to the follower.

The means for admitting pressurized fluid into the hose preferably comprises a source of compressed air or another gaseous fluid. The hose can be provided with a second opening at the other side of the follower, and such second opening can receive pressurized fluid from the aforementioned source or from a different source so as to cause the follower to return to its original position, for example, close to the first mentioned opening.

The track can include arcuate and straight sections and can serve to properly guide a substantially U-shaped follower. One of the aforementioned rolls or rolling elements can be said to constitute a bearing which engages the track and reduces friction between the track and the follower so that the latter can be propelled along the track by a fluid medium which is admitted into the hose at a relatively low pressure.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
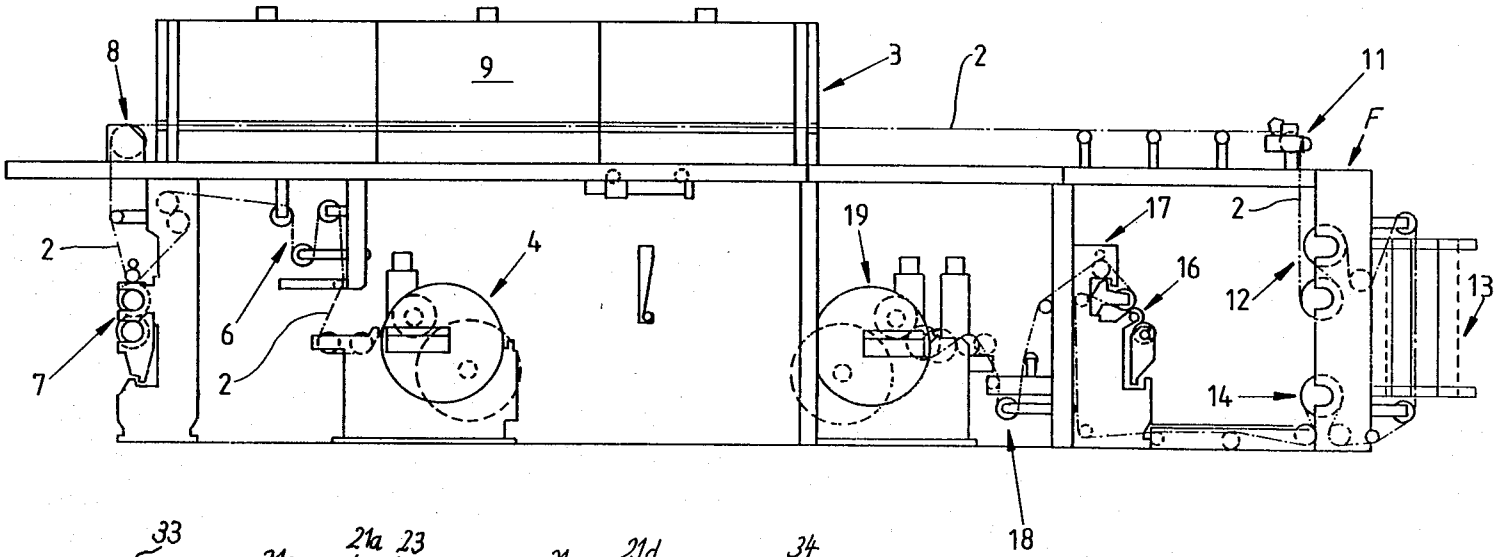
FIG. 1 is a schematic side elevational view of a processing machine which employs a web threading apparatus embodying one form of the invention.

FIG. 1 shows a machine wherein an elongated flexible body 2 (e.g., a web of paper or the like) is subjected to a series of successive or simultaneous treatments during travel along an elongated path which includes straight as well as arcuate portions or sections. The machine of FIG. 1 can be used to provide one side of the web 2 with a coat or layer which replaces conventional carbon paper. A machine frame F supports a coating unit 3 wherein one side of the running web 2 is coated in a manner not forming part of the present invention. The frame F further supports a supply reel 4 which stores a length of convoluted paper web 2 and is located ahead of a set of dancer rolls 6 which flex and/or tension the web 2 ahead of an applicator 7 which provides one side of the web with one or more films of suitable coating material and is followed by a tensioning roll 8 at the inlet end of an elongated floating or suspended dryer 9. The dryer 9 is followed by a tension monitoring device 11 which precedes a cooler 12. The latter is followed by a conditioning chamber 13 which, in turn, is followed by a second cooler 14 ahead of an imprinting mechanism 16. The mechanism 16 is followed by a severing device 17 which divides the web 2 into two or more elongated webs or strips of lesser width. The thus obtained strips are trained over a set of dancer rolls 18 and are collected by one or more takeup reels 19. It will be seen that the elongated path which extends from the supply reel 4 to the takeup reel or reels 19 is quite complex, at least in part, and that it would require much time and effort in order to thread the leader 2*a* (FIG. 2) of the web 2 into and along such path by hand or in another rudimentary way.

Figure 2:
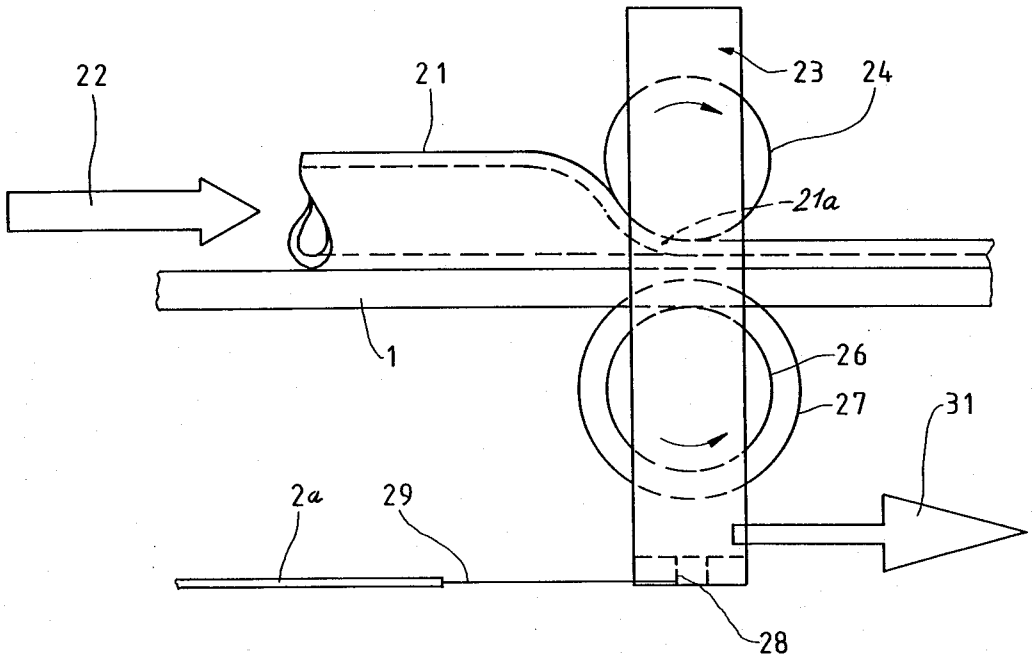
FIG. 2 is a side elevational view of a portion of the threading apparatus, further showing the leader of the web.
Figure 3:
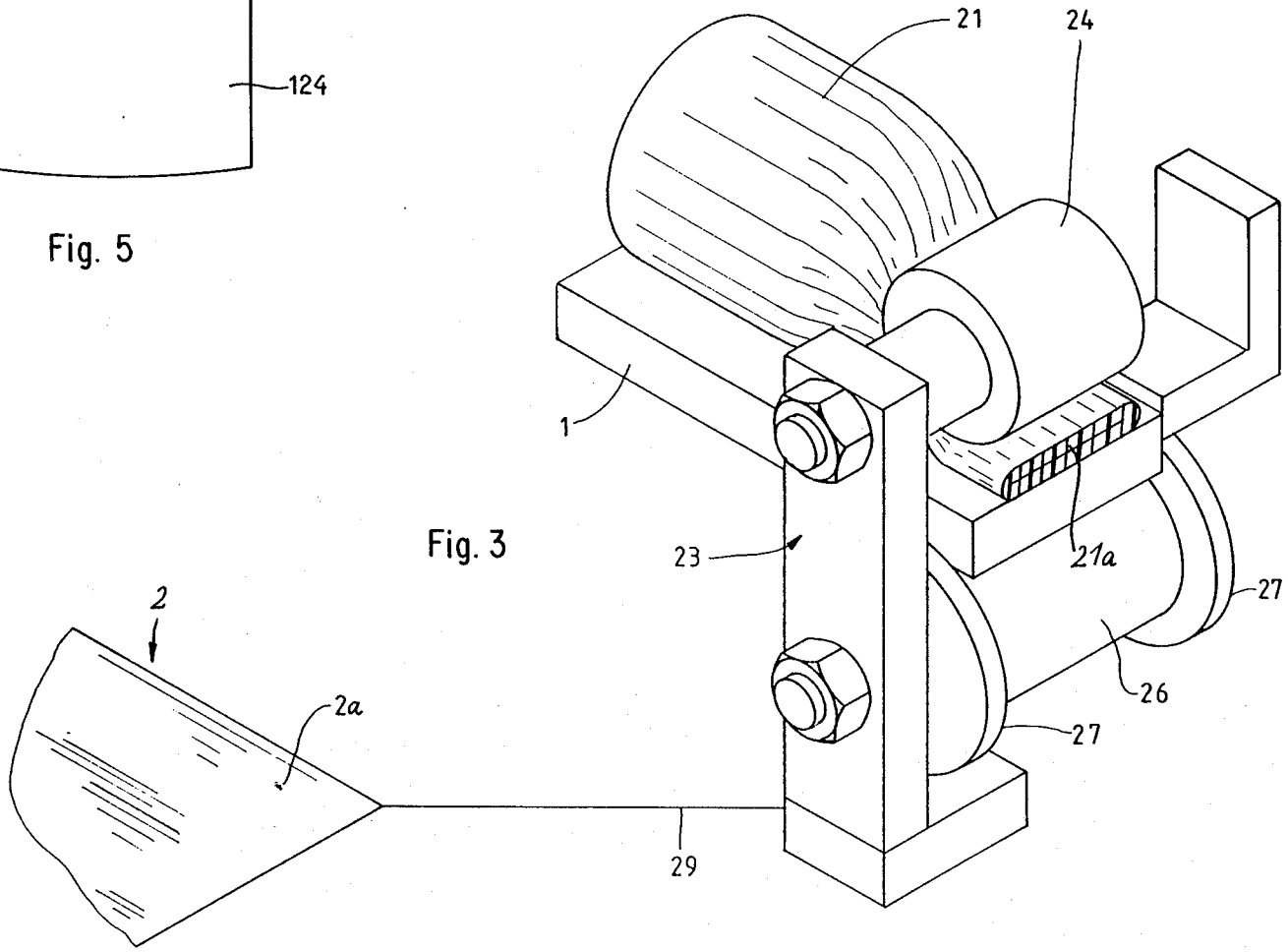
FIG. 3 is an enlarged perspective view of the structure which is shown in FIG. 2.

The improved threading apparatus includes an elongated track 1 in the form of a strip-shaped rail made of steel or another suitable wear-resistant material which can be readily deformed so that its shape conforms to that of the path extending from the supply reel 4 to the takeup reel or reels 19. The track 1 is mounted on or adjacent to the machine frame F. As can be seen in FIGS. 2 and 3, one side of the track 1 is overlapped by an elongated flexible and inflatable hose 21 which can be made of a suitable elastomeric or non-elastic material and a portion (at 21*a*) of which is deformed by a rolling element 24 in the form of a substantially cylindrical roll forming part of a substantially U-shaped follower 23 having a second rolling element 26 in the form of a spool bearing whose core engages the other side of the track 1 and which is provided with two flanges 27 flanking the edge faces of the track so that the follower 23 is compelled to travel along the track as soon as it is set in motion. The width of the clearance between the rolling elements 24, 26 suffices to receive the track 1 and the deformed portion 21*a* of the hose 1. A rope or cord or wire 29 forms part of a means for attaching the follower 23 to the leader 2*a* of the web 2, and the attaching means further comprises a simple or complex coupling device 28 which can separably secure the wire, rope or cord 29 to the adjacent portion of the follower 23. The illustrated coupling device 28 can include a slot or notch or hole which is provided in the follower 23 and enables the operator to temporarily attach the wire, rope or cord 29 to the follower. The wire, rope or cord 29 can be replaced by a strip of plastic or textile material without departing from the spirit of the invention. The term "wire or cord" is intended to denote any suitable connection between the leader 2*a* of the web 2 and the follower 23. Such leader 2*a* can be provided with a wire or cord at the manufacturing plant so that the wire or cord need not be affixed to the leader 2*a* at the locale of the machine which is shown in FIG. 1.

The arrow 22 indicates the direction of propulsion of the follower 23 and leader 2*a* when the leader 2*a* is properly attached to the follower and the latter is caused to advance along the track 1 in the direction of arrow 31 in response to admission of a pressurized fluid (such as compressed air or another gas) by way of an opening 21*c* at one side of the follower 23. Such fluid inflates the hose 21 all the way of the nip of the rolling element 24 and the track 1 and causes the expanding hose to push the rolling element 24 in the direction of arrow 31 whereby the elements 24, 26 respectively roll along the hose 21 and along the opposite side of the track 1 to entrain the leader 2*a* of the web 2 into and thereupon along the aforedescribed path which extends from the supply reel 4 to the takeup reel or reels 19.

Figure 4:
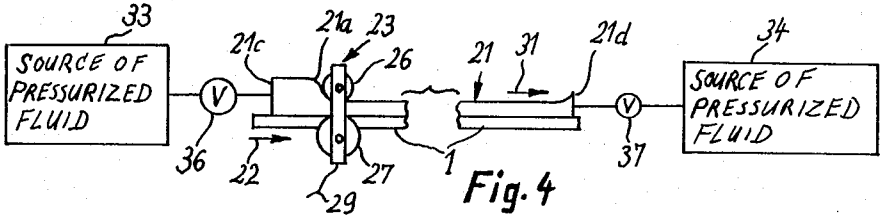
FIG. 4 is a fragmentary. diagrammatic plan view of the threading apparatus.

FIG. 4 shows, very schematically, the entire threading apparatus including the two end portions of the track 1, the respective end portions of the hose 21, the follower 23, the wire or cord 29, a first source 33 of pressurized fluid which can admit fluid into the opening 21*c* at the left-hand end of the hose 21, and a second source 34 of pressurized fluid which can be actuated to admit pressurized fluid into an opening 21*d* at the right-hand end of the hose 21 so as to propel the follower 23 in the opposite direction, i.e., back toward the starting position adjacent the supply reel 4. A first valve 36 can be manipulated to connect the opening 21*c* with the source 33 or with the atmosphere, and a second valve 37 can be manipulated to connect the opening 21*d* with the source 34 or with the atmosphere.

Figure 5:
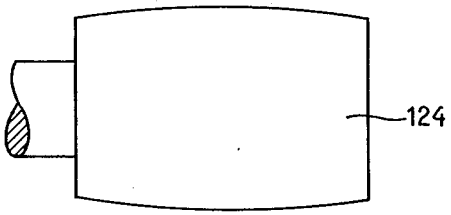
FIG. 5 is an elevational view of a modified rolling element.

The rolling element 24 can have a smooth peripheral surface which :s preferably slightly convex (see the rolling element 124 in FIG. 5) to promote the flattening and sealing action upon the adjacent portion 21*a* of the hose 21. The wire or cord 29 extends transversely between the path of the follower 23 along the track 1 and the path of the leader 2*a* of the web 2 from the supply reel 4 toward the takeup reel or reels 19. When the threading operation is completed, the wire or cord 29 is detached from the coupling device 28 and the valve 37 is actuated to connect the opening 21*d* of the hose 21 with the source 34 of pressurized fluid so that the follower 23 is returned to its starting position. It is equally within the purview of the invention to replace the illustrated track 1 of finite length with an endless track so that one of the sources 33, 34 can be omitted. Furthermore, the apparatus can employ several hoses, for example, a discrete hose at each of two opposite sides of the track.

Since the leader 2*a* of the web 2 need not be thickened or otherwise deformed for the purpose of attaching it to the follower 23, the leader 2*a* can be readily pulled through the nips of various rolls and can be readily trained around several rolls which define portions of the path without resorting to means for forcibly increasing the width of the nips in order to enable the leader 2*a* to pass therethrough. This contributes to simplicity and lower cost of the threading apparatus and of the entire machine.

The improved threading apparatus exhibits a number of important advantages. Thus, the threading operation is quiet and, in fact, practically noiseless. The apparatus occupies space which can be readily found in machines for treating elongated flexible bodies of paper or the like, and the wear upon the parts of the apparatus is negligible. The need for lubrication is minimal or nil. The follower 23 can be rapidly returned to its starting position to be held in a state of readiness for the next threading operation.

Certain units of the machine which is shown in FIG. 1 are or can be similar to or identical with those which are described and shown in the commonly owned copending patent application Ser. No. 211,351 filed June 24, 1988 by Albert Hebels and Ralph Pagendarm for "Method of and apparatus for reducing tension in webs of thermoplastic material".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for threading the leader of an elongated flexible body, such as a web of plastic material or paper, into an elongated path, comprising an elongated track adjacent and having an outline at least substantially conforming to that of the path, said track having a first side and a second side; a deformable and inflatable hose adjacent said first side of said track; a follower connectable with the flexible body and mounted on said track so as to deform the adjacent portion of said hose, said follower including a first portion overlying the hose and a second portion at the second side of said track, said hose having an opening at one side of said follower; and means for admitting a pressurized fluid into said hose by way of said opening so that the pressurized fluid inflates the hose at said one side of the follower and the inflated hose propels the follower along said track in a predetermined direction.

2. The apparatus of claim 1, wherein said track includes a rail.

3. The apparatus of claim 1, wherein said track includes an elongated strip.

4. The apparatus of claim 3, wherein said strip contains a metallic material.

5. The apparatus of claim 4, wherein said strip contains steel.

6. The apparatus of claim 1, wherein said first portion of said follower comprises a first rolling element which is in deforming engagement with said hose, said second portion of said follower including a second rolling element in engagement with said second side of said track.

7. The apparatus of claim 6, wherein said rolling elements define a clearance for said track and for a portion of the hose in deflated condition of such portion of the hose.

8. The apparatus of claim 6, wherein at least one of said rolling elements has flanges and said track is disposed between said flanges.

9. The apparatus of claim 8, wherein said at least one rolling element is said second rolling element.

10. The apparatus of claim 1, wherein said first portion of said follower includes a roll which engages and maintains in deflated condition an adjacent portion of said hose.

11. The apparatus of claim 10, wherein said roll has a smooth peripheral surface in contact with said portion of said hose.

12. The apparatus of claim 10, wherein said roll has a convex peripheral surface in contact with said portion of said hose.

13. The apparatus of claim 1, further comprising means for attaching the follower to the flexible body.

14. The apparatus of claim 13, wherein said attaching means comprises a length of wire or cord.

15. The apparatus of claim 14, wherein said attaching means further comprises means for separably coupling the wire or cord to said follower.

16. The apparatus of claim 1, wherein said admitting means comprises a source of compressed gaseous fluid.

17. The apparatus of claim 1, wherein said hose has a second opening at the other side of said follower and further comprising means for admitting a pressurized fluid into the hose by way of said second opening so as to propel the follower counter to said predetermined direction.

18. The apparatus of claim 1, wherein said track includes arcuate and straight sections.

19. The apparatus of claim 1, wherein said follower is substantially U-shaped.

20. The apparatus of claim 1, wherein said second portion of said follower has a bearing which engages said track.

* * * * *